United States Patent [19]

Sobreira

[11] 4,079,657

[45] Mar. 21, 1978

[54] DRUM APPARATUS

[76] Inventor: Ralph J. Sobreira, 3518 Alohea Ave., Honolulu, Hawaii 96816

[21] Appl. No.: 636,841

[22] Filed: Dec. 2, 1975

[51] Int. Cl.[2] ..... G10D 13/02

[52] U.S. Cl. ..... 84/411 R; 84/411 A; 84/415

[58] Field of Search ..... 84/411–419

[56] References Cited

U.S. PATENT DOCUMENTS

| | | | |
|---|---|---|---|
| 1,236,667 | 8/1917 | Bower | 84/415 |
| 1,595,451 | 8/1926 | Cole et al. | 84/411 A |
| 2,115,741 | 5/1938 | Newberry | 84/411 A |
| 2,433,200 | 12/1947 | Cordes | 84/415 |
| 2,564,933 | 8/1951 | Somerville | 84/411 A |
| 3,113,481 | 12/1963 | Thompson | 84/415 |

FOREIGN PATENT DOCUMENTS

| | | | |
|---|---|---|---|
| 958,415 | 3/1950 | France | 84/411 A |
| 442,257 | 11/1948 | Italy | 84/413 |
| 519,089 | 3/1940 | United Kingdom | 84/415 |

*Primary Examiner*—Lawrence R. Franklin

*Attorney, Agent, or Firm*—James C. Wray

[57] ABSTRACT

A drum has a shell and tracks at opposite end of the shells. Inner and outer rings move within the tracks. The outer ring is constrained for vertical movement, and the inner ring is constrained for circumferential movement. At least one of the rings has a plurality of inclined planes, and the other ring has followers of the inclined planes. The followers have convex surfaces for fitting in concave surfaces of the inclined planes. A rack extending circumferentially on the inner ring has teeth shaped like ratchets. Turning gears turn the rack, and a latch successively engages the teeth. Lifting the latch permits the inner ring to move backward circumferentially allowing the follower rollers to slide down the inclined plane.

The tracks and shells are covered by split hoops having inward hinges and latches. The bottom hoop has bulbous extensions to receive a snare assembly which moves upward and downward on pins in the bulbous extensions by a lever with a two positioned detent for holding the snares against the bottom drum head or away from the bottom drum head.

18 Claims, 11 Drawing Figures

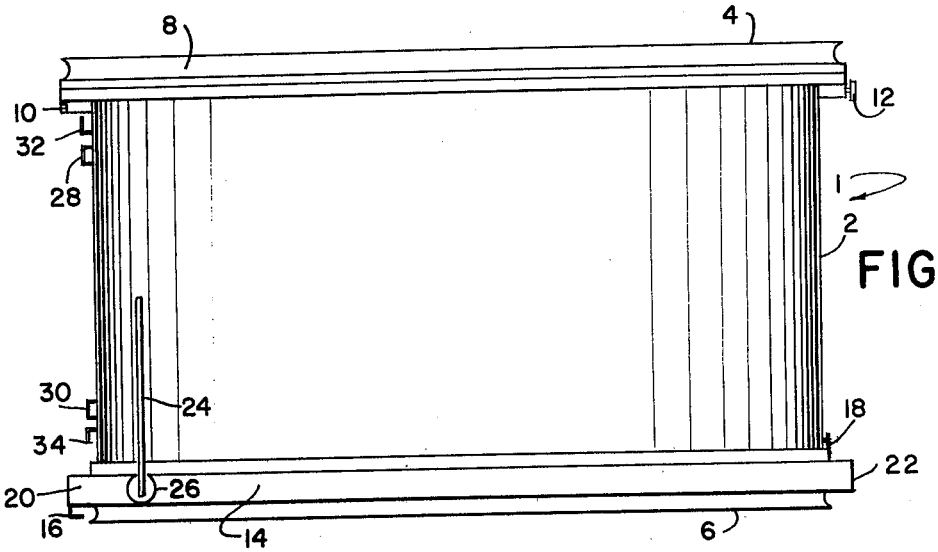
FIG. 1
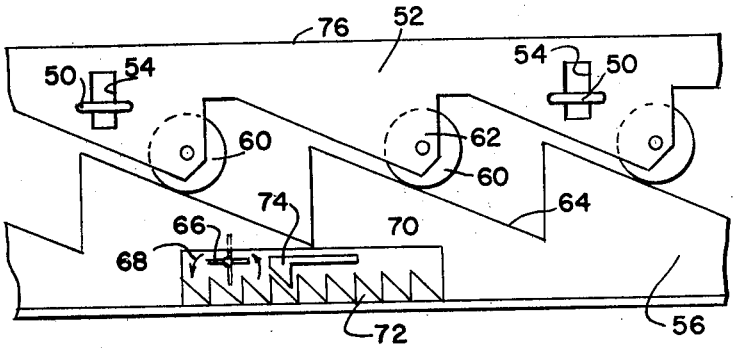
FIG. 2
FIG. 3
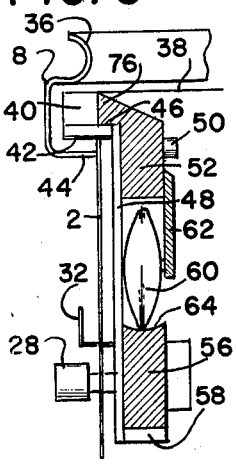
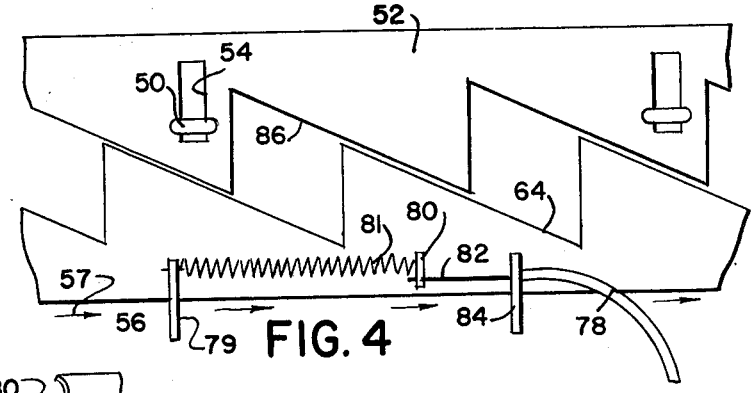
FIG. 4
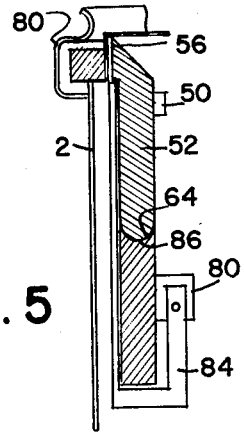
FIG. 5
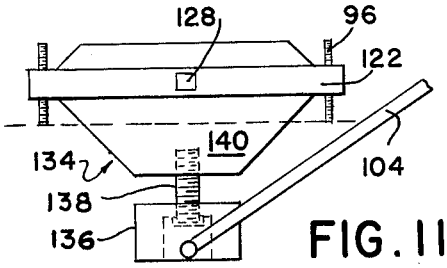
FIG. 11

DRUM APPARATUS

BACKGROUND OF THE INVENTION

Before the application was filed a search was made in the United States Patent Office, and that search produced U.S. Pat. No. 2,115,741.

A copy of that patent has been filed with the present application as a disclosure of prior art. Many problems exist in the use of prior art devices, and these problems are overcome by the present invention.

SUMMARY OF THE INVENTION

The tuning assembly is a device designed for tightening a drum head with one tuning screw rather than from six to ten screws previously necessary. The tuning assembly is used on snare drums, marching drums, tom toms, base drums, practice pads, and even banjos. With a slight variation the assembly is used for tympani and variable tone tom toms.

This tuning assembly is different from those now in general use. Rather than tightening the drum head by pushing the head down over the drum shell; instead, the assembly pushes the shell up against the drum head. This is accomplished by the use of a series of inclined planes, working one against the other, and forming a jack which applies pressure against the inside of the drum head.

There are many advantages to this system. First, it applies absolutely even pressure and tension over the entire drum head rather than the uneven tension accomplished by present screw type, tuning systems. This is because the upper edge of the drum shell raises up against the drum head all at one time and to the same degree for the entire circumference of the drum. The tuning device is operated by turning one gear, with a drum key fitting, rather than tightening six to ten screws as is necessary on existing equipment.

Another advantage of the assembly is that because of the absence of tuning screws the changing of worn or broken drum heads is greatly simplified. The tension on the drum head is relieved by releasing a ratchet. Then the unique metal counter hoop is removed, the drum head is changed, and the drum is retuned, all within seconds rather than minutes. Even the bottom head of a snare drum is changed quickly and easily because the entire snare and throwoff systems are built into the lower counter hoop. The snares are fully extended and are easily adjusted both vertically and horizontally.

Still another advantage is that with the total absence of lugs, there is more freedom to explore the different possibilities of decorative finishes. Colors, designs, pictures, metalwork, leather, etc. can be used to create new and exciting effects never before possible. Without bothersome lugs and screws to get in the way, drummers find it far easier to clean and polish their equipment.

A final, but very important advantage is the fact that the new drums have far fewer parts than drums presently available. In addition, with the exception of the counter hoops and throwoff switch, none of the parts have to be chrome plated because they are inside the drum. With the combination of fewer parts, less plating, and savings in labor due to simpler assembly, production costs of the drums are substantially reduced.

The upper metal counter hoop is similar in appearanc to those previously in use, but it is in two parts connected by a hinge and catch at opposite sides of the hoop. Also, the counter hoop has a special lip on the under side, around the entire circumference, which connects it to the drum when the hoop is in the closed position. This lip is also very important to counter the pressure needed to tighten the drum head.

The hinge is connected to the under side of the hoop. The use of the hinge makes it easier to remove and replace the hoop quickly. The catch is also on the under side of the hoop and is used to keep the hoop in the closed position around the drum.

The lower counter hoop is similar to the upper hoop, but the lower hoop is deeper so as to contain the snare assembly. On tom toms and other such drums the lower counter hoop is exactly like the upper since there is no snare assembly.

Another difference in the lower hoop for snare drums is the slight bulge at two opposite sides to accommodate the fully extended snares and the difference in the position of the hinge and catch. The hinge on the lower hoop is on the under side of the bulge in the hoop. The catch on the lower hoop is in the same position as that on the upper hoop but is directly in the middle of the bulge opposite the hinge.

There are only two drum key fittings for tuning the drum heads, one for the top drum head and one for the bottom. Turning these fittings with a drum key puts the mechanism inside the drum to work applying pressure to the drum head.

There are two ratchet release switches, one for the top drum head and one for the bottom. The ratchet holds the tension on the drum head when the desired tuning has been achieved. The ratchet must be released before the drum head can be loosened.

A snare throwoff switch is used to raise or lower the snares against the bottom of the drum.

The shell of the drum can be constructed from any material presently in use such as metal, wood or fiberglass.

An upper ring with a series of inclined planes on its lower surface fits inside the drum. The circumference of the ring is nearly equal to that of the inside of the drum. When the tuning mechanism is put into motion, this ring moves up pushing against the underside of the drum head. Any number of inclined planes can be used although the minimum is three. The ring should be made of a strong smooth material such as nylon, metal, or fiberglass.

An inside of the top of the ring is beveled and slightly overlaps the shell of the drum. The bottom edge of the ring is convex, for a tongue and groove type fitting with the lower ring.

The lower ring in the upper assembly is equal in size to the upper ring. The lower ring has a series of inclined planes on its upper edge which correspond to those on the under side of the upper ring. When the tuning mechanism is put into motion the lower ring moves horizontally while the upper ring is constrained for vertical movement forcing the upper ring up against the drum head.

The top edge of the lower ring is indented concave for a tongue and groove type fitting with the upper ring.

A vertical ring guide pin keeps the upper ring from moving horizontally with the lower ring. The upper ring. must move vertically because it cannot move horizontally.

In a preferred embodiment rollers connected to one of the rings move in concave curves of inclined planes of the other ring. The number of wheels corresponds to the number of inclined planes.

The tuning gear assembly is attached to or molded into the lower ring. When the gear is turned by the drum key fitting outside the drum, the lower ring is moved horizontally.

A track for the inclined plane assembly goes completely around the inside of the drum. The top of the track is attached to the upper edge of the drum shell and extends between the drum head flesh hoop and the lip of the counter hoop. The bottom of the track is shaped to hold and support the inclined plane assembly. The track is made of strong steel.

A ratchet locks the inclined plane assembly in place when the desired drum head tension is achieved. The ratchet release switch is put into the off position before the drum head can be loosened.

The shell or outside of the drum gives vertical support to the tracks.

The drum key fitting extending through the shell is used to turn the tuning gear inside the drum.

The shell of the drum is constructed from any material presently in use such as metal, wood, fiberglass, etc.

The drum head flesh hoop and drum head are as is presently used in standard equipment.

The metal counter hoop has a lip or extension which passes under a corresponding extension protruding from the shell of the drum. Both the lip on the drum shell and the lip on the hoop go completely around the drum so as to give firm and absolutely even support when the drum head is tightened.

Two halves of the counter hoop may be separated for easy removal from the durm when necessary. A hinge is connected to the under side of the hoop. Use of the hinge makes it easier to remove and replace the hoop quickly. The catch is also on the under side of the hoop diametrically opposite the hinge and is used to keep the hoop in the closed position around the drum. The counter hoop catch is spring loaded for surer locking and snug fit.

One of the unique features of the lower counter hoop for snare drums is the fact that the entire snare and throwoff assembly is built into the hoop. This feature eliminates the necessity of dismantling the snare assembly as is the case on existing equipment.

When the hoop is in the open position, for removal from the drum, the snares and throwoff assembly remain in position on the hoop. The parallel bars give support to the snares and provide for the horizontal snare adjustment.

The snares are fully extended so that only the snares touch the drum head. The ends of the snares do not extend too far beyond the drum so as to keep the rim bulge to an absolute minimum. The snare assembly is connected to the counter hoop. The vertical guide pins keep the snare assembly moving in a straight line when the throwoff switch is used.

A drum key fitting screw is used to adjust the horizontal tension of the snares.

At the opposite end from the horizontal adjustment screw, the snares are screwed to the end of the parallel bars and are not adjustable from the end.

There is a drum key fitting vertical adjustment screw at each end of the snares. These are used to adjust the snares for maximum contact with the drum head.

The snare throwoff assembly raises and lowers the snares by lever action when the handle is moved. The snare throwoff lever is put into the off position when the drummer wants a tom tom sound from the snare drum. The lever controls the raising and lowering of the snares. The snare throwoff switch holds the snares in the desired on or off position.

Rivets connecting the leverage arms to the snare assembly are loose fitting so that the rivets turn when the arms are moved.

Guide pins are connected to the snare assembly holders, which in turn are connected to the counter hoop. The guide pins keep the snare assembly moving in a straight line when the throwoff switch is used.

The guide pin holes are loose fitting so as to allow the snare assembly to move up and down freely.

One object of this invention is the provision of drum sound changing apparatus comprising a drum shell, upper and lower track assemblies connected to the drum shell, and upper and lower rings mounted in each track assembly, at least one of the rings having a plurality of inclined planes vertically oriented around a circumference of a drum, and the other of the rings having means for engaging the inclined planes, the outer of the rings being constrained for vertical movement, and the inner of the rings having turning means connected to the inner ring for latching the inner ring in a particular circumferential rotational position, thereby controlling distance of the outer ring from a remote end of the drum.

Another object of the invention is the provision of drum sound changing apparatus wherein the means connected to the other of the rings is a plurality of rollers connected to apexes of the other ring, whereby the rollers roll on the inclined planes for smoothly moving the rings in relative circumferential rotation.

Another object of the invention is the provision of drum sound changing apparatus wherein the rollers are mounted on the outer rings and the inclined planes are on the inner rings and further comprising inward projections on the outer rings, arms connected to the inner projection and extending inwardly from the projections, and wherein the rollers are connected to distal ends of the arms for engaging the inclined planes.

The invention has as another object the provision of drum sound changing apparatus wherein the inclined planes have concave surfaces for receiving convex circumferential surfaces of the rollers, whereby the rollers are held in the concave surfaces of the inclined planes.

Another object of this invention is the provision of drum sound changing apparatus wherein the turning means is a circumferential rack connected to the inner ring, the rack having ratchet like unidirectionally oriented teeth, and a pinion gear connected to the rack and extending out of the track for turning the rack, and wherein the latch comprises a ratchet sequentially engaging the teeth of the rack, and further comprising means for releasing the ratchet to permit the rack to drive the pinion in the reverse direction.

Another object of this invention is the provision of drum sound changing apparatus wherein the means for turning the inner ring comprises a coaxial cable having an inner member connected to the moveable ring and having an outer member connected to the track, and operating means connected to a remote end of the coaxial cable for pulling the inner end with respect to the outer end, and thereby turning the inner ring with respect to the track.

The invention has as another object the provision of drum sound changing apparatus with a counter hoop connected to the shell in the area of the track, the counter hoop comprising two semi-cylindrical sections and a hinge connected between first ends of the sections on an inner side of the hoop facing the shell, and a catch connected to the opposite ends of the sections on an inner side of the hoop adjacent the shell, whereby releasing the catch permits removal of the hoop from the shell.

Another object of this invention is the provision of drum sound changing apparatus wherein the counter hoop comprises a lower counter hoop with bulbous extensions in opposite sections of the hoop diametrically opposed from each other, a plurality of downward extending pins connected to the counter hoop within the bulbous extensions, and a snare assembly connected across the pins, holes in the snare assembly for moving along the pins, and a lever means and bar connected to the counter hoop and extending across the counter hoop near the snare assembly, and means connecting the lever means and bar to the snare assembly for moving the snare assembly downward along the pins upon movement of the bar, whereby the snare assembly is moved away from a drum head.

The invention has as another object the provision of drum sound changing apparatus comprising first and second detent means connected to the lever and to the counter hoop and spring means urging the detent means into interconnection, one of the detent means having two positions, for holding the lever in one of two positions with respect to the hoop, whereby the snare assembly is held in a first position next to the drum or in a second position away from the drum according to the interrelationship of the detent means.

These and other and further objects of the invention are apparent in the disclosure which includes the specification and claims and drawings.

BRIEF DESCRIPTION OF THE DRAWINGS

FIG. 1 is a schematic elevation of a drum of the present invention.

FIG. 2 is a schematic representation of the tightening of the drum head.

FIG. 3 is a detail of the tightening apparatus shown in FIG. 2.

FIG. 4 is a detail of a related cable driven tightening apparatus.

FIG. 5 is a detail of the apparatus shown in FIG. 4.

FIG. 11 is a detail of the vertical snare adjustment assembly.

DETAILED DESCRIPTION OF THE DRAWINGS

Figure 6:
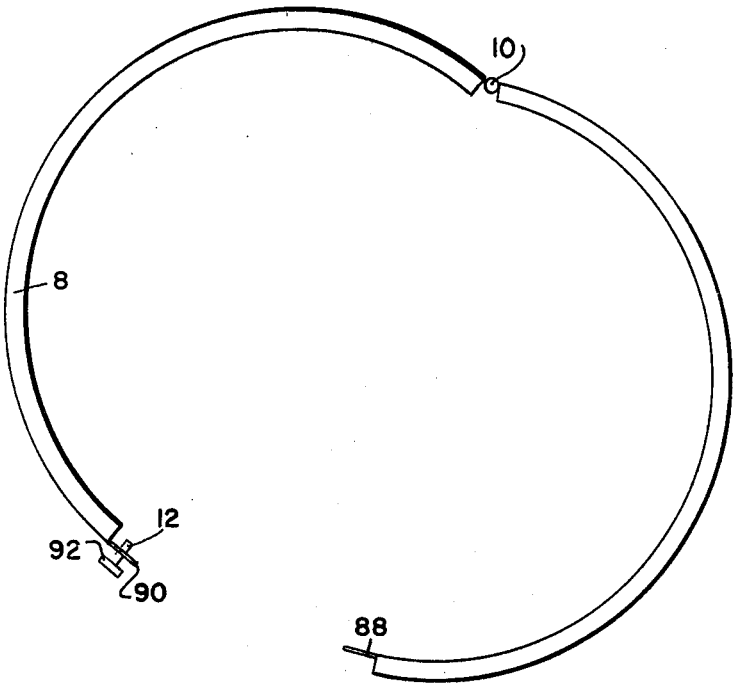
FIG. 6 is a detail of a hinged counter hoop assembly.

Referring to FIG. 1, a snare drum is generally referred to by the numeral 1. Drum 1 has a conventional drum cylinder 2, which in this case may be lightly constructed since it is not required that drum cylinder 2 carry the tension of the skins on the top of the drum.

Drum 1 has an upper surface 4 and bottom 6. A top counter hoop 8 is constructed out of metal and has inward projections which fit over an outward upper projection on the drum cylinder and over the drum top, forming a rim slightly above the upper drum surface, as is conventional.

The top metal counter hoop 8 is formed in two semi-cylindrical sections joined by a hinge pin and a spring loaded catch 12 at the opposite side.

A lower counter hoop 14 is constructed similar to upper counter hoop 8. A hinge 16 and a spring loaded latch 18 connect the semi-cylindrical sections of bottom counter hoop 14. The bottom counter hoop has outward extensions 20 and 22 for holding vertical pins upon which a snare assembly slides as will later be explained. Lever 24 and detent 26 control the raised-active and lowered-deactivated positions of the snares.

Drum key fittings 28 and 30 are provided to tighten the drum heads. Releases 32 and 34 release the tension of the drum heads.

As shown schematically in FIGS. 2 and 3, the top counter hoop 8 has a upper rim curve 36 which holds drum head 38 and the attached drum head flesh hoop 40 tightly against the upper outwardly extending flange 42 of drum shell 2. The lower inward extending lip 44 of counter hoop 8 engages the outward extending flange 42.

An outwardly extending lip 46 of support track 48 is held tightly between the flesh hoop 40 and the shell flange 42 to secure tuning track 48 in place. Fixed inward extensions 50 on tuning track 48 constrain upper moveable ring 52 to vertical movement. Vertically oriented apertures 54 along the ring slide along the fixed lugs 50 on the tuning track.

A lower, horizontally moveable ring 56 is fitted in cylindrical track 48 on top of the lower flange 58 of the track for horizontal sliding movement along the lower flange.

Wheels 60 connected to downward extensions 62 of the upper ring ride upon grooved inclined surfaces 64 of the lower ring.

The lower ring is forceably moved horizontally by a pinion 66 turned in the direction of arrows 68 by a drum key fitted in fitting 28. The turning sprocket engages teeth 70 of the rack 72 which is connected to the lower ring. Ratchet 74 engages the teeth 70 as they are turned, holding the ring in its new position until ratchet 74 is released by lifting lever 32 on the outside of the drum shell.

As wheels 60 ride up the inclined plane 64, controlled by the turning of pinion 66, the upper edge 76 of the upper ring presses upward against the drum head 38, tightening the drum head.

A similar structure is shown in FIG. 4, wherein the lower ring 56 is moved in the direction of arrows 57 by a coaxial cable 78 which has a distal end connected to a moving device such as a conventional foot pedal. Brace 79 is connected to track 48. Control brace 80 is connected to the lower ring 56. Return tension spring 81 is connected between brace 79 and control brace 80, and the sliding wire 82 from coaxial cable 78 is connected to the control brace. The outer tension member of coaxial cable 78 is abutted against brace 84 which is connected to the track 48.

As shown in FIG. 4, complimentary inclined planes 64 and 86 slide upon each other to change the tension of the drum head. As wire 82 is pulled, plane 64 is pulled beneath plane 86, causing plane 86 to move upward, lifting ring 52 against the drum head. The inclined plane 86 of ring 52 is convexly curved to fit within the concave curvature of planes 64 in a manner similar to that shown in FIG. 3 to keep the upper and lower ring elements together.

When pressure is applied to the foot pedal the drum head is tightened and the pitch of the drum is raised. When pressure is released from the pedal the drum head is automatically loosened and the pitch of the drum is lowered.

The tuning system shown in FIGS. 4 and 5 can also be used for tuning tympani with the addition of a locking mechanism on the foot pedal so that the drum will remain at the desired pitch until it is changed manually by the tympanist.

The rings fit inside the drum with its circumference nearly equal to that of the inside of the drum. When the tuning mechanism is put into motion the upper, outer ring moves up pushing against the underside of the drum head. The ring has a series of inclined planes on its underside. Any number of inclined planes can be used though the minimum is three. The ring is made of a strong smooth material such as nylon, metal, or fiberglass.

This lower, inner ring is equal in size to the upper ring. It has inclined planes on its upper, outer edge which correspond to those on the under side of the upper ring. When the tuning mechanism is put into motion, ring 56 moves horizontally forcing ring 52 up against the drum head.

The vertical ring guide pins 50 keep ring 52 from moving horizontally with ring 56. Ring 52 must move vertically because it cannot move horizontally.

An "L" brace 79 is connected to the track or to the side of the drum. A cable 82 is fastened from brace 84 to the control brace 80 so that, when pressure is applied to the foot pedal, the horizontally moveably ring 56 is pulled, activating the tuning mechanism and making the drum head tighter.

FIG. 6 shows the hoop 8, the hinge 10 and the latch 12. Hinge 10 may be simple piano type hinge. Latch 12 comprises two overlapping lugs 88 and 90 which have central holes. A spring mounted pin 92 is urged inward by its spring to engage the hole in lug 88, holding the hoop together. The pin and lugs may be mounted on the lower inward projecting lip 44 of hoop 8 to conceal the pin from accidental operation.

Figure 7:
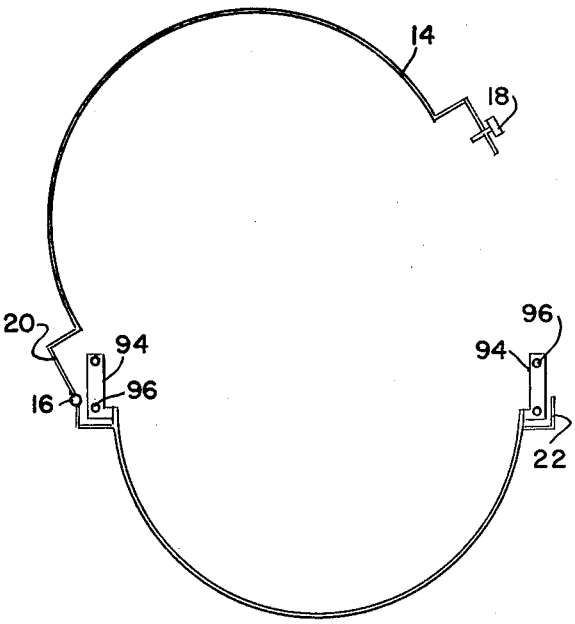
FIG. 7 is a detail of a lower hoop assembly.

As shown in FIG. 7, the lower hoop 14 is constructed in a manner similar to the upper hoop. A piano hinge 16 joins the two semi-cylindrical halfs of the hoop and a latch 18 with a spring loaded pin fitted between complimentary lugs is provided on the other side of the loop. Outward extensions 20 and 22 hold mounting brackets 94 upon which vertical pins 96 are mounted.

Figure 8:
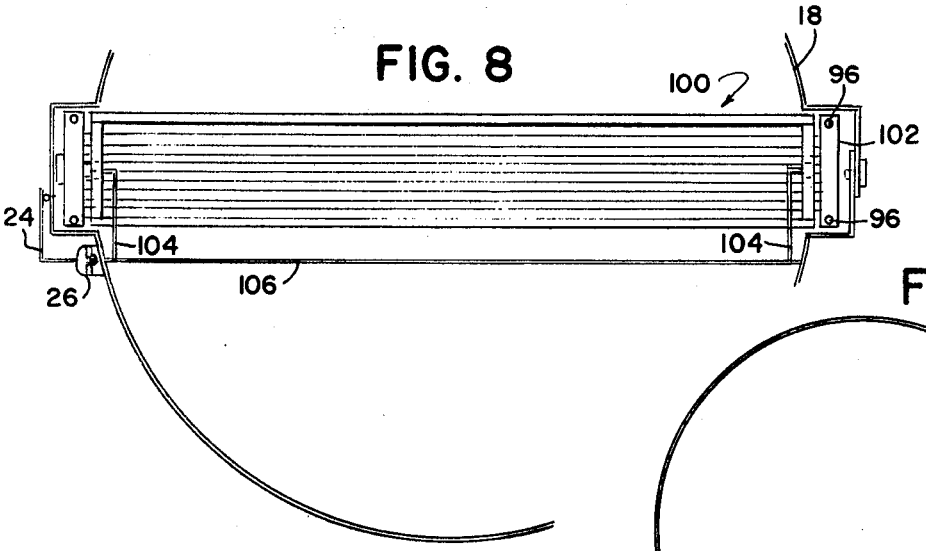
FIG. 8 is a bottom view of the drum showing the snare assembly.

As shown in FIG. 8 a snare assembly 100 is mounted on the lower counter hoop 18. Pins 96 fit through holes in box 102 so that the snare assembly may be moved up and down along the pins by levers 104 which are connected to an arm 106 which is turned by lever 24. Detent 26 holds the lever 24 and arm 106 in either first or second angular positions which correspond with the raised operative position of the snares and the lowered inoperative position.

Figure 9:
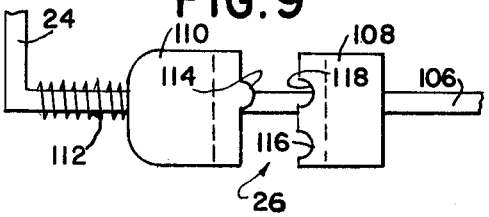
FIG. 9 is an enlarged detail of the throwoff switch for the snare assembly.

As shown in FIG. 9 the lever 24 is a continuation of shaft 106. Detent 24 has two parts. A first cylindrical section 108 is connected to the lower hoop 18. A second section 110 is keyed to shaft 106 and slides along the shaft under the influence of a compression spring 112. As lever 24 is turned, lug 114 fits in either depression 116 or 118 to hold the lever 24 and shaft 106 in the desired angular position.

Figure 10:
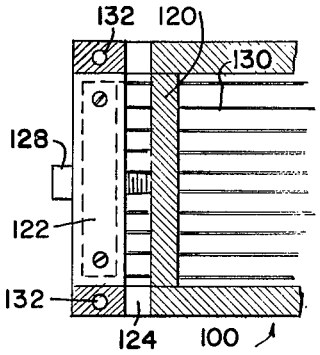
FIG. 10 is a detail of the snare tuning assembly, showing the vertical guide pin holes for sliding on the vertical guide pins attached to the lower counter hoop.

As shown in FIG. 10, one end of the snare assembly is constructed with a bridge 120 and a slide 122 which moves outward from the bridge along tracks 124 as controlled by screw 128 which is mounted for rotation in the slide and abutment with bridge 120. Ends of snares 130 are firmly anchored in slide 122, and turning screw 128 to move slide 122 away from bridge 120 tightens the snares 130. Holes 132 in the slide receive the vertical pins 96 so that the slide may move along the vertical pins. The opposite end of the snare assembly is constructed as a rigid snare anchor with the holes 132 but without the tensioning slide.

As shown in FIG. 11 the vertical snare turning assembly 134 has a block 136 and adjusting screw 138 connected between throwout arm 104 and the block 140. Block 140 is connected to and is an integral part of slide 122. Alternatively, block 140 is integrally formed with bridge 120. Turning adjusting screw 138 out of block 140 moves the snare assembly 100 closer to the drum.

Although the invention has been described with reference to specific embodiments, it will be obvious to those skilled in the art that modifications and variations may be made without departing from the spirit and scope of the invention. The scope of the invention is defined in the following claims.

I claim:

1. Drum sound changing apparatus comprising a drum shell, upper and lower track assemblies connected to the drum shell, and upper and lower rings mounted in each track assembly, at least one of the rings having a plurality of inclined planes vertically oriented around a circumference of a drum, and the other of the rings having means for engaging the inclined planes, the outer of the rings being constrained for vertical movement, and the inner of the rings having turning means connected thereto for turning the inner ring with respect to the outer ring and changing relationship of the inclined planes to followers of the inclined planes, and latch means connected to the inner ring for latching the inner ring in a particular circumferential rotational position, thereby controlling distance of the outer ring from a remote end of the drum, wherein the turning means comprises a circumferential rack connected to the inner ring, the rack having ratchet like unidirectionally oriented teeth, and a pinion gear connected to the rack and extending out of the track for turning the rack, and wherein the latch comprises a ratchet sequentially engaging the teeth of the rack, and further comprising means for releasing the rachet to permit the rack to drive the pinion in the reverse direction.

2. The apparatus of claim 1 when the means connected to the other of the rings is a plurality of rollers connected to apexes of the other ring, whereby the rollers roll on the inclined planes for smoothly moving the rings in relative circumferential rotation.

3. The apparatus of claim 2 wherein the rollers are mounted on the outer rings and the inclined planes are on the inner rings and further comprising inward projections on the outer rings, arms connected to the inner projection and extending inwardly from the projections, and wherein the rollers are connected to distal ends of the arms for engaging the inclined planes.

4. The apparatus of claim 3 wherein the inclined planes have concave surfaces for receiving convex circumferential surfaces of the rollers, whereby the rollers are held in the concave surfaces of the inclined planes.

5. The apparatus of claim 1 wherein;

the drum shell has outwardly extending flanges at the upper and lower ends;

the track assemblies have outwardly extending lips abutting the flanges, and further comprising;

drum heads having circumferential hoops abutting the lips, and;

counter hoops connected to the drum heads and flanges for holding the lips tightly between the hoops and the flanges.

6. The apparatus of claim 1 wherein the means for turning the inner ring comprises a coaxial cable having an inner member connected to the moveable ring and having an outer member connected to the track, and operating means connected to a remote end of the coaxial cable for pulling the inner end with respect to the outer end, and thereby turning the inner ring with respect to the track.

7. The apparatus of claim 1 further comprising;

latch release means connected to the latch means and projecting through the track assemblies for selectively releasing the latch means.

8. The apparatus of claim 1 wherein;

the track assemblies have axial portions spaced radially inwardly of the shell, the rings abutting the axial portions.

9. Drum sound changing apparatus comprising a drum shell, upper and lower track assemblies connected to the drum shell, and upper and lower rings mounted in each track assembly, at least one of the rings having a plurality of inclined planes vertically oriented around a circumference of a drum, and the other of the rings having means for engaging the inclined planes, the outer of the rings being constrained for vertical movement, and the inner of the rings having turning means connected thereto for turning the inner ring with respect to the outer ring and changing relationship of the inclined planes to followers of the inclined planes, and latch means connected to the inner ring for latching the inner ring in a particular circumferential rotational position, thereby controlling distance of the outer ring from a remote end of the drum, further comprising a counter hoop connected to the shell in the area of the track, the counter hoop comprising two semi-cylindrical sections and a hinge connected between first ends of the sections on an inner side of the hoop facing the shell, and a catch connected to the opposite ends of the sections on an inner side of the hoop adjacent the shell, whereby releasing the catch permits removal of the hoop from the shell.

10. The apparatus of claim 9 wherein the counter hoop comprises a lower counter hoop with bulbous extensions in opposite sections of the hoop diametrically opposed from each other, a plurality of downwrd extending pins connected to the counter hoop within the bulbous extensions, and a snare assembly connected across the pins.

11. The apparatus of claim 10 further comprising holes in the snare assembly for moving along the pins, and a lever means and bar connected to the counter hoop and extending across the counter hoop near the snare assembly, and means connecting the lever means and bar to the snare assembly for moving the snare assembly downward along the pins upon movement of the bar, whereby the snare assembly is moved away from a drum head.

12. The apparatus of claim 11 further comprising first and second detent means connected to the lever and to the counter hoop and spring means urging the detent means into interconnection, one of the detent means having two positions, for holding the lever in one of two positions with respect to the hoop, whereby the snare assembly is held in a first position next to the drum or in a second position away from the drum according to the interrelationship of the detent means.

13. Drum apparatus comprising a cylindrical drum body and a drum head connected to a first end of the drum body and a lower counter hoop connected to a lower end of the drum body, the lower counter hoop having pin mounting means in opposite sections of the hoop diametrically opposed from each other, a plurality of downward extending vertical pins connected to the counter hoop within the mounting means, and a snare assembly connected across the pins and moving means to move the snare assembly up and down along the pins.

14. The apparatus of claim 13 comprising holes in the snare assembly for moving along the pins, and wherein the moving means comprising an arm connected to the counter hoop and extending across the counter hoop near the snare assembly, a control lever connected to one end of the arm and connectors secondary levers connecting the arm to the snare assembly for moving the snare assembly downward along the pins upon rotational movement of the arm when the control lever is moved, whereby the snare assembly is moved away from a drum head.

15. The apparatus of claim 8 further comprising block means connected to the snare assembly and screw adjustment means connected to the block means and to the secondary levers for adjusting position of the block means and snare assembly with respect to the secondary levers.

16. The apparatus of claim 15 further comprising first and second detent means connected to the arm and to the counter hoop and spring means urging the detent means into interconnection, one of the detent means having two positions, for holding the arm in one of two positions with respect to the hoop, whereby the snare assembly is held in a first position next to the drum or in a second position away from the drum according to the interrelationship of the detent means.

17. The drum apparatus of claim 15 wherein the block means are connected to ends of a frame and snares extend through the block means and are anchored in anchor blocks spaced from the block means and frame and further comprising adjusting screws connected between the anchor blocks and frame for moving the anchor blocks with respect to the frame and lightening and loosening the snares.

18. The drum apparatus of claim 17 wherein the holes in the snare assembly for receiving the pins are located along edges of the anchor blocks.

* * * * *